US005216906A

United States Patent [19]

Kurrasch

[11] Patent Number: 5,216,906

[45] Date of Patent: Jun. 8, 1993

[54] DOOR LOCK MECHANISM

[75] Inventor: Andrew J. Kurrasch, Saugatuck, Mich.

[73] Assignee: Herman Miller, Inc., Zeeland, Mich.

[21] Appl. No.: 318,643

[22] Filed: Mar. 2, 1989

[51] Int. Cl.[5] ..... E05B 65/06

[52] U.S. Cl. ..... 70/103; 70/DIG. 65; 292/16; 292/42; 292/74; 292/153; 292/302; 292/DIG. 21

[58] Field of Search ..... 70/DIG. 65, 79, 80, 70/103; 292/153, 99, 106, DIG. 21, 74, 70, 16, 302, 42, 32, 33, DIG. 14

[56] References Cited

U.S. PATENT DOCUMENTS

| | | | |
|---|---|---|---|
| 139,430 | 5/1873 | Smith | 292/153 X |
| 505,893 | 10/1893 | Cabus | 292/74 |
| 1,013,553 | 1/1912 | Johnson . | |
| 1,194,022 | 8/1916 | Hudson | 70/90 |
| 1,421,197 | 6/1922 | Ferrara . | |
| 1,599,901 | 9/1926 | Kwiecinski . | |
| 1,684,134 | 9/1928 | Le Mesurier . | |
| 1,762,015 | 6/1930 | Francis . | |
| 1,937,425 | 11/1933 | Falk . | |
| 2,038,835 | 4/1936 | Frost | 292/16 |
| 2,097,653 | 11/1937 | Williams | 70/98 |
| 2,795,947 | 6/1957 | Peras | 292/DIG. 14 |
| 3,008,319 | 11/1961 | Cheney | 292/42 X |
| 3,206,954 | 9/1965 | Snyman | 292/74 X |
| 3,752,520 | 8/1973 | Sprick | 292/152 X |
| 4,503,691 | 3/1985 | Li | 70/312 |

FOREIGN PATENT DOCUMENTS

| | | | |
|---|---|---|---|
| 73849 | 10/1917 | Austria | 292/32 |
| 609896 | 12/1960 | Canada | 292/DIG. 14 |
| 405164 | 10/1924 | Fed. Rep. of Germany | 292/33 |
| 403317 | 9/1909 | France | 292/16 |
| 632412 | 10/1927 | France | 292/16 |
| 430369 | 6/1935 | United Kingdom | 292/74 |
| 1261702 | 1/1972 | United Kingdom | 292/DIG. 14 |

*Primary Examiner*—Lloyd A. Gall

*Attorney, Agent, or Firm*—Varnum, Riddering, Schmidt & Howlett

[57] ABSTRACT

A door lock mechanism for a pair of doors oppositely hung on the frame of a cabinet. The door lock mechanism comprises a pair of studs, one to be attached respectively to each door, a lock body to be attached to the frame, and a latch assembly carried on the lock body and provided by a pair of latch members and a spring urging the latch members to their latching positions. Each of the studs has a camming head at its free end which cooperates with a portion of the lock body to guide the stud into a cavity provided in the lock body as the respective door is closed. Each stud is also provided with a recess adapted to receive a detent end portion of one of the latch members to releasably retain the respective door in its closed position.

9 Claims, 3 Drawing Sheets

DOOR LOCK MECHANISM

BACKGROUND OF THE INVENTION

1. Field of the Invention

This invention relates to a door lock mechanism and more particularly to a door lock mechanism for holding a door in a closed position relative to a frame supporting the door in locked or unlocked condition, and for aligning the door with a second door or with the frame.

2. Description of Related Art

The invention is particularly useful in conjunction with doors which provide access to enclosures such as trophy cases, china cabinets, gun cabinets, and display cases of myriad types. In each of these settings it is desirable to be able to retain the door in a closed position for reasons of safety to passersby and security to the contents of the enclosure. It is also desirable that the door be easily moveable from the closed position by the application of an outwardly directed force to the door; however, the degree of force necessary to open the door should not be so slight as to cause it to be opened inadvertently, for example as a result of vibrations caused by passersby.

Examples of means used to retain doors or similar elements in a closed position are disclosed in Falk U.S. Pat. No. 1,937,425, issued Nov. 28, 1933, which discloses a latching mechanism suitable for use with an automobile glove compartment; Francis U.S. Pat. No. 1,762,015, issued Jun. 30, 1930, which discloses a means for securing a cash box cover in a closed position; and Johnson U.S. Pat. No. 1,013,553, issued Jan. 2, 1912. Similarly, Frost U.S. Pat. No. 2,038,835, issued Apr. 28, 1936, discloses an enlarged head on a latch member which is received between a pair of spring-loaded plungers to secure the doors of a vehicular trailer in a closed position. Williams U.S. Pat. No. 2,097,653, issued Nov. 2, 1937, discloses a pair of opposed spring-loaded bullet catches which are received by slots in a plate disposed between the catches.

Sprick et al. U.S. Pat. No. 3,752,520, issued Aug. 14, 1973, discloses a rounded stud head which is received by a slot in a latch plate that must be actuated manually to release the stud from holding a cargo container door in the closed position.

It is often advantageous to be able to lock the door in its closed position, for example to protect the contents of the enclosure from theft, vandalism, or unintended damage. Accordingly, some prior patents disclose, in combination with a means for releasably retaining a member in a given position, a means for locking the member in that position. An example is the patent to Falk noted above. Another is Hudson U.S. Pat. No. 1,194,022, issued Aug. 8, 1916, which discloses a device for locking a window sash in a window frame.

Finally, there are many instances in which it is important for the door to be aligned with its frame when it is closed or for one door to be aligned with another. If the door is not properly aligned, there may be unnecessary stress imposed on the door, its frame, the hinge or other means by which the door is secured to the frame, as well as the door's closing and locking mechanisms. This stress can cause accelerated deterioration of the foregoing components and require early repair or replacement. Also, a misaligned door may amount to an invitation to attempt unauthorized entry of the disclosure. Furthermore, especially in the case of furniture of quality, a properly aligned door contributes to the article's overall aesthetic appearance.

Since the means for retaining a door in a closed position, locking the door in that closed position, and aligning the door within its frame or relative to another door are closely related and often simultaneously utilized, it is advantageous to provide a single mechanism which incorporates the means necessary for realizing all these features.

SUMMARY OF THE INVENTION

The lock mechanism according to the present invention comprises in its broader aspects a stud preferably attachable to the door, a lock body preferably attachable to the frame, and latch means cooperable with the stud and the lock body to retain the door in its closed position. The stud is provided with an attachment base at one end, a tapering camming surface at its opposite or free end, and a latching recess between the two. The lock body includes a cavity for receiving the stud as the door is moved to its closed position. A rim portion of the lock body defines an entrance to the cavity and is formed to cooperate with the camming head to guide the stud into the cavity and thereby correct any misalignment of the door.

The latch means is carried on the lock body and comprises a latch member mounted for reciprocating movement transversely relative to the cavity to and from a latching position in which a detent end portion of the latch member obtrudes into the cavity to be seated in the latching recess of the stud when the latter is received in the cavity, thus releasably retaining the door in its closed position. The latch means also includes biasing means urging the latch member toward the latching position.

In a preferred embodiment of the invention, a security lock means, carried by the lock body and suitably key actuated, is movable between an unlocked position and a locked position obstructing movement of the latch member from the latching position to prevent the door from being moved from the closed position.

The invention is well suited for use in conjunction with a pair of doors hingedly supported on a frame for movement toward and away from one another to and from adjacent closed positions. In such an application a pair of studs is provided for attachment respectively to the doors. The lock body is accordingly provided with a pair of stud-receiving cavities, and the latch means comprises a pair of latch members. The latch members are so oriented with respect to one another and to the lock body that a single security lock means may be employed to obstruct movement of both from their respective latching positions and thus prevent both doors from being moved from the closed positions.

These and other features and advantages of the invention will be apparent from the ensuing description in conjunction with the accompanying drawings.

BRIEF DESCRIPTION OF THE DRAWINGS

For a more complete understanding of the invention reference should now be had to the embodiment thereof illustrated in the accompanying drawings and described hereinafter by way of example.

In the drawings.

DETAILED DESCRIPTION OF THE PREFERRED EMBODIMENT

Figure 1:
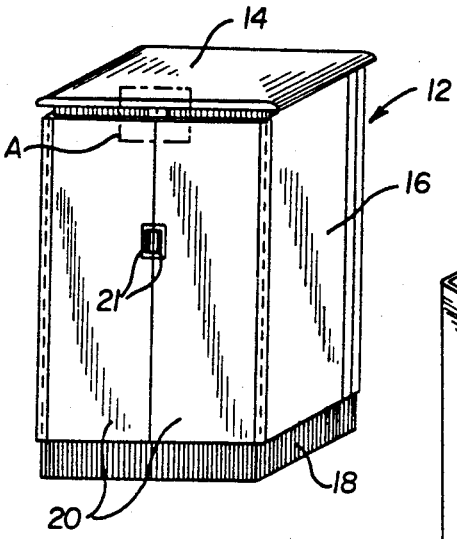
FIG. 1 is a perspective view of a cabinet of a type in which a door lock mechanism according to the invention may be employed.
Figure 3:
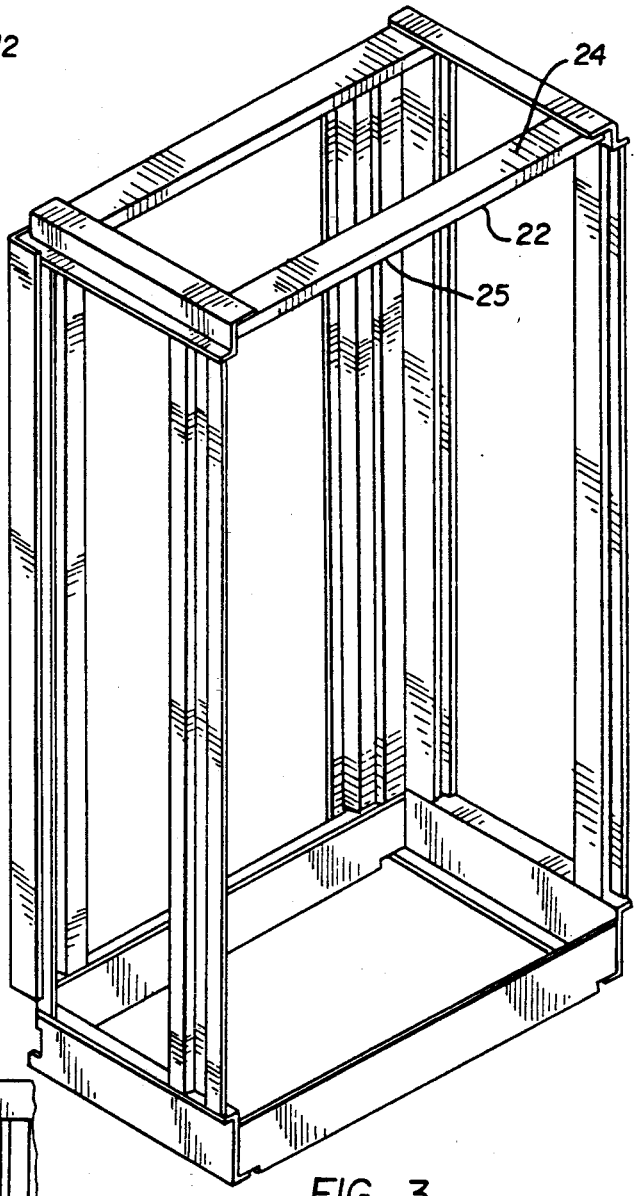
FIG. 3 is a perspective view of a type of frame which may be employed in the cabinet shown in FIG. 1.
Figure 2:
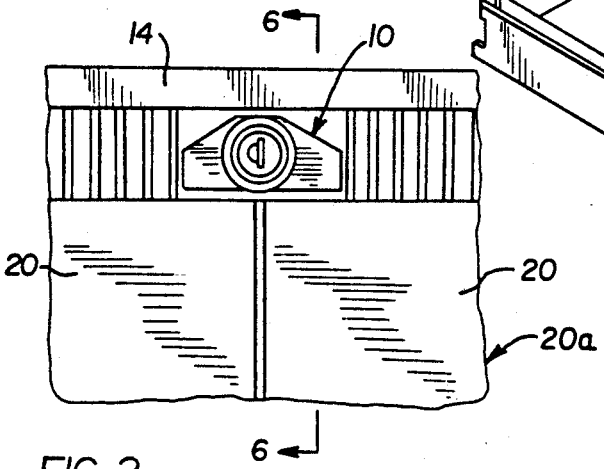
FIG. 2 is an enlarged perspective view of the area designated by reference character A in FIG. 1.

Referring now particularly to FIG. 1, the invention in the form of a door lock mechanism 10 is shown in conjunction with a cabinet 12, which is of a general type in which the invention may be employed, it being understood that the cabinet 12 forms no part of the invention in its broader aspects nor is the use of the door lock mechanism 10 restricted to such an application. For purposes of illustration, the cabinet 12 comprises a top 14, a pair of sides 16, a base 18, a pair of doors 20, and a pair of door handles 21. The area of principal interest, which is indicated by interrupted lines at A in FIG. 1, is shown in greater detail in the enlarged perspective view of FIG. 2. FIG. 3 is a perspective view of a type of frame which may be employed in constructing the cabinet 12, it again being understood that the frame is not a feature of the door lock mechanism 10 of the invention. In FIG. 3, the door lock mechanism 10 is shown by way of example as being secured to a bottom surface 22 of a front horizontal cross-member 24 at a location designated by reference numeral 25.

Figure 4:
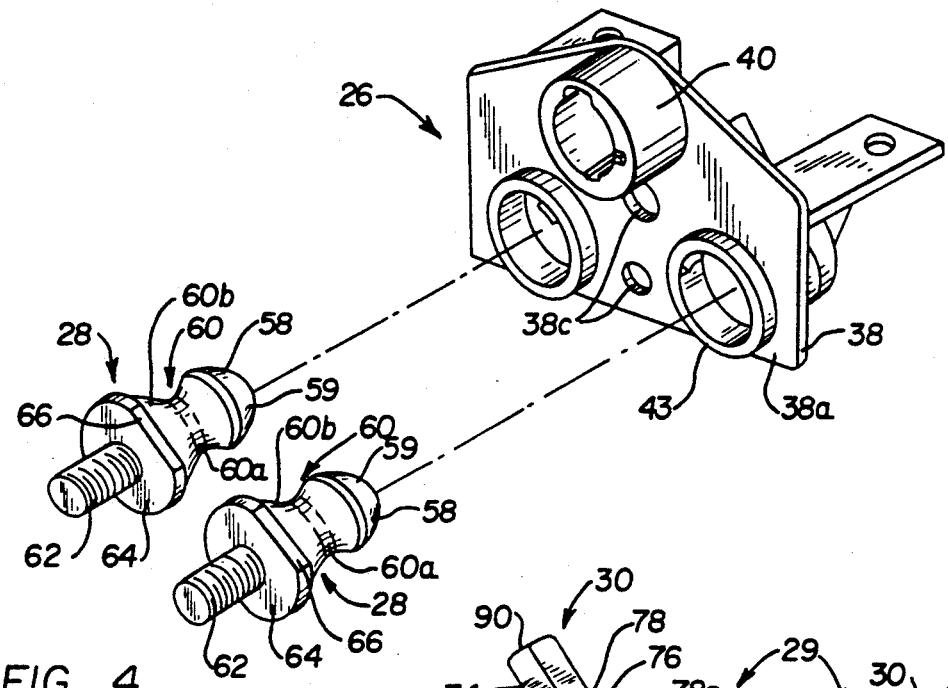
FIG. 4 is a front exploded perspective view of a door lock mechanism according to the invention.
Figure 6:
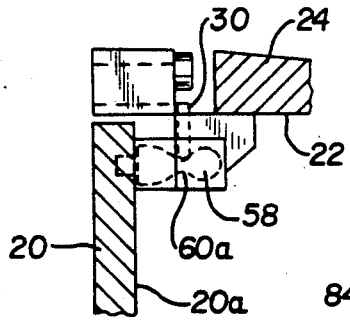
FIG. 6 is a sectional view taken along line 6—6 of FIG. 2.
Figure 5:
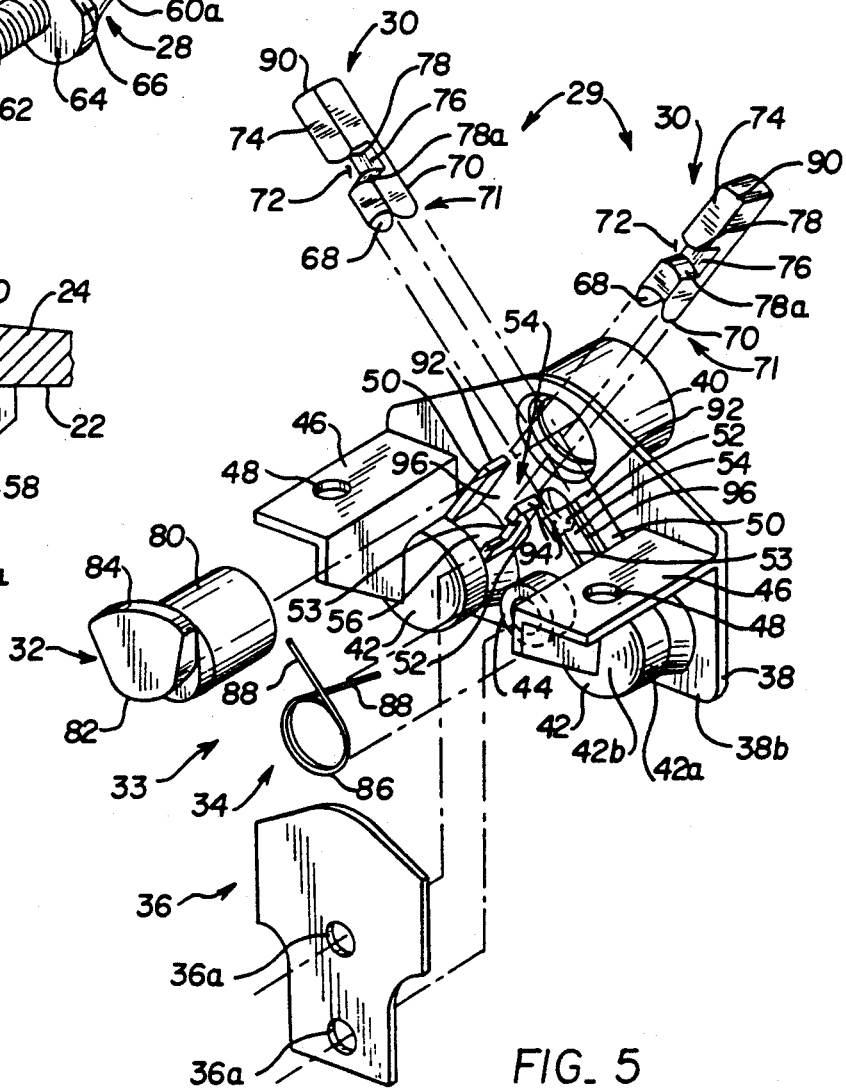
FIG. 5 is a rear exploded perspective view of the door lock mechanism of FIG. 4.

Referring now to FIGS. 4 to 6, the door lock mechanism 10 comprises a lock body 26, a pair of studs 28, latch means 29, a security lock means 32, and a retaining plate 36.

The lock body 26 is preferably cast of zinc to resist oxidation and comprises a base plate 38 to which is mounted a housing 40 for the security lock means 32. A pair of cavities are defined respectively by a pair of bilaterally symmetrical cup members 42, each comprising a lateral wall 42*a* and a bottom wall 42*b* closing the lateral wall at the inner end thereof. The cup members 42 open toward a front face 38*a* of the base plate 38 to extend inwardly thereof and are adapted to receive the studs 28. A boss 44 is positioned between the cup members 42 and protrudes inwardly (relative to the cabinet 12) from a back face 38*b* of the base plate 38. The base plate 38 is provided with means 45 for securing it to the frame, which may be in the form of a pair of L-shaped brackets 46 integral with the base plate 38, and which in the arrangement depicted mount the door lock mechanism 10 (of which the base plate 38 is a part) to the bottom surface 22 of the front horizontal cross-member 24 of the frame. This is done by means of screws (not shown in the drawings) which register with holes 48 in the L-shaped brackets 46.

The lock body 26 further comprises a pair of upper flanges 50 and a pair of lower flanges 52 which project inwardly (relative to the cabinet 12) from the back face 38*b* of the base plate 38. Each of the two upper and lower flanges 50, 52 are in parallel spaced relationship and cooperate to define a channel 54 therebetween. Each channel 54 is aligned with an aperture 56 formed in the respective cup member 42. Each of the lower flanges 52 is provided with a slot 53.

Each of the studs 28 comprises an attachment base 62 at one end thereof, a camming head 58 at a free end of the stud opposite to the base 62 and provided with a tapering forward camming surface 59, which is preferably axisymmetrical, and means defining a latching recess 60 intermediate the base 62 and the camming head 58. The latching recess 60 further comprises an annular groove 60*a*, an annular side of which is formed by a rear camming surface 60*b* inclined inwardly of the stud 28 and away from the camming head 58 thereof. The attachment bases 62 may be in the form of threaded lugs to allow the studs 28 to be screwed into the respective doors 20 by way of an interior surface 20*a* thereof. A collar 64 formed with bilateral flattened sections 66 permits use of a wrench to tighten the threaded engagement of the studs 28 with the doors 20.

The latch means 29 comprises a pair of latch members 30, each of which is essentially an elongated rectangular element having a radiused groove 68 formed in an end 70 thereof terminating a detent end portion 71, and a notch 72 interrupting an inner lateral surface 74. Each notch 72 comprises a back surface 76 offset from the inner lateral surface, and a pair of opposed upper and lower convex side surfaces 78, 78*a* formed so that the length of the notch 72 is smaller at its center than at either side. The latch members 30 are disposed respectively within the channels 54.

The security lock means 32 comprises a key-actuated cylinder lock 80 and a locking cam 82 which is mounted to rotate with the cylinder lock 80. The locking cam 82 is formed with an enlarged tab 84 at one end. The latch means 29 includes biasing means 33 which comprises, for example, a torsion spring 34 formed in well-known manner with a central helical portion 86 and a pair of leg portions 88 extending from the central portion.

In assembly, the cylinder lock 80 is received in the housing 40 of the lock body 26. The latch members 30 are positioned within the channels 54 in a manner such that the radiused groove 68 in the detent end portion 71 of each latch member 30 registers with the aperture 56 in the respective cup member 42. Further, the notch 72 in each latch member 30 is aligned with the slot 53 in the respective lower flange 52. The central helical portion 86 of the torsion spring 34 is fitted over the boss 44 in a supporting relationship therewith so that each of the spring leg portions 88 lie at once within one of the slots 53 of the lower flanges 52 and against the lower convex curved side surface 78*a* of the respective notch 72. The spring 34 acts to bias latch member downwardly to urge its detent end portion into the cavity provided by respective cup member 42 by way of the aperture 56 therein. The retaining plate 36 may be secured to the base plate 38 with screws which register with aligned holes 36*a* and 38*a* (respectively in the retaining plate 36 and the base plate 38) to protect the lock body 26 and the other components of the door lock mechanism 10.

In operation, the cabinet doors 20 are moveable between three positions: open, closed-unlocked, and closed-locked. In the open position, the doors 20 stand ajar relative to the cabinet 12 and the studs 28 do not register with the lock body 26.

Moving the doors 20 to one of the two closed positions causes the studs 28 to interengage with the cup members 42 of the lock body 26. The camming heads 58 of the studs 28 ride into the cup members 42 and, because the maximum diameter of the camming head 58 is only slightly smaller than the inside diameter of rim portions 43, each defining an entrance to the respective cup member 42, the registration of the camming heads 58 with the cup members 42 aligns the doors 20 with the cabinet 12 and with one another as each is moved to the closed position.

As the heads 58 ride into the cup members 42, they also engage the detent end portions 71 of the latch members 30 obtruding into the cup members 42 by way of the apertures 56. Each latch member 30, being mounted for sliding, reciprocating movement transversely relative to the cup members 42, is vertically displaced (as best shown by the phantom lines of FIG. 7) until the continued forward movement of the camming heads 58 into the cups 42 (i.e. the continued closing movement of the doors 20) causes the detent end portion 71 of each latch member 30 to engage the rear camming surface **60*b* and drop into the respective annular groove 60*a* to be seated in the latching recess 60 of the respective stud 28. The latch members 30 are so dimensioned that when the doors 20 are in their closed positions, an upper end 90 of each latch member 30 is collinear with the upper ends 92, 94 of the upper and lower flanges 50, 52. Thus, the latch members 30 releasably retain the studs 28 within the cup members 42 to releasably retain the doors 20** in a closed position.

From the closed-unlocked condition, the doors 20 may be opened by simply grasping the door handles 21 and pulling outward with sufficient force to overcome the tension of the biasing means 33 and enable the latches 30 to ride over the camming heads 58. As when the doors 20 are moved to a closed position from the open position, the latches 30 are vertically displaced (as best shown by the phantom lines of FIG. 7) when they ride over the camming heads 58 as the doors 20 are moved to an open position. When the studs 28 have been fully withdrawn from the cup members 42, the biasing action of the torsion spring 34 returns the latch members 30 to the positions wherein the detent end portions 71 obtrude into the cup members 42 by way of the apertures 56 therein.

The door lock mechanism 10 may be adjusted to place the doors in a closed-locked condition. Specifically, and by way of example, only a single key (not shown in the drawings) need be provided. The key may be inserted in the cylinder lock 80 and rotated to rotate the enlarged tab 84 of the locking cam 82 about the axis of locking cylinder 80, from the position shown in FIG. 7 (closed-unlocked) to that shown in FIG. 8 (closed-locked). As can be seen in FIG. 8, rotation of the cylinder lock 80 causes the enlarged tab 84 to move to a position partially in line with and closer to upper ends 96 of the channels 54. In this position, the enlarged tab 84 prevents the vertical displacement of the latch members 30 that would otherwise occur if the doors 20 were moved from their closed positions (as described above). Since such vertical displacement is prevented, the studs 28 cannot be withdrawn from the cups 42 and therefore the doors 20 cannot be opened.

Figure 7:
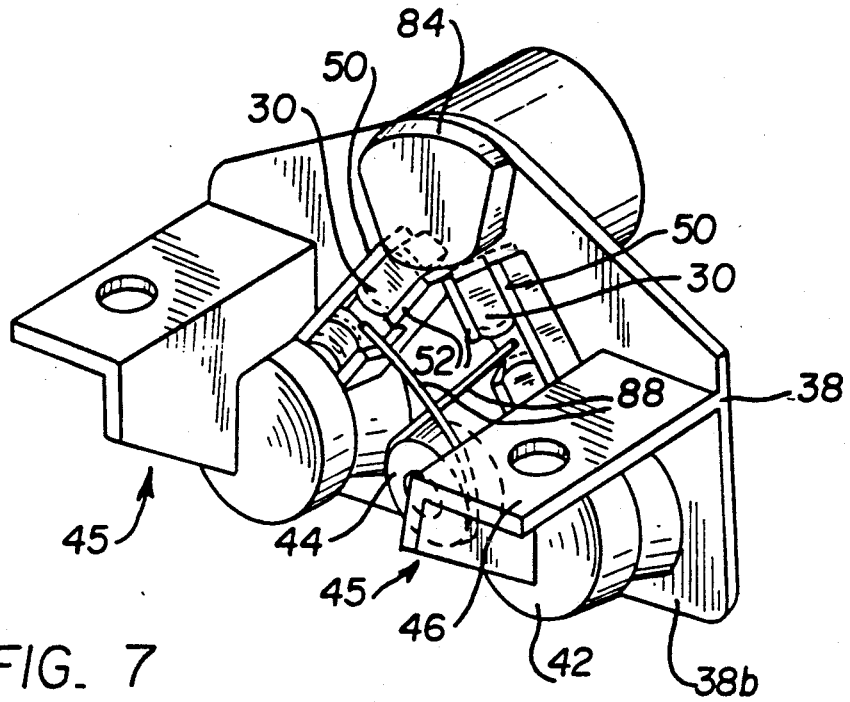
FIG. 7 is a rear perspective view similar to FIG. 5 but showing the lock mechanism for a door in partially assembled form, showing the cylinder lock in an unlocked position, and showing in phantom lines the displacement of the latch members which occurs when the cabinet doors are moved between open and closed positions.
Figure 8:
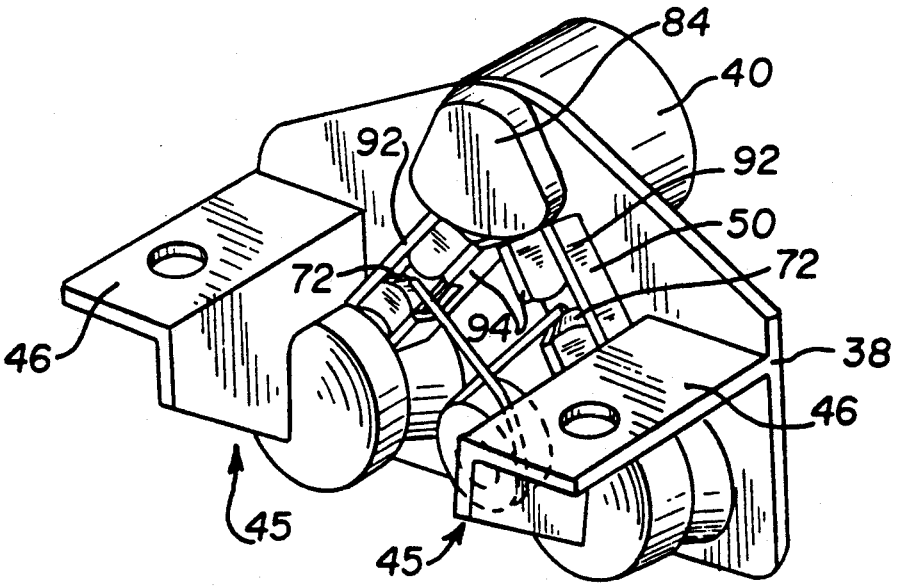
FIG. 8 is a rear perspective view similar to FIG. 7 but showing the lock mechanism for a door in a closed and locked condition.

It will be readily apparent that the closed-unlocked condition may be reinstated by using the key to rotate the enlarged tab 84 to the position shown in FIG. 7.

Although the invention has been explained as having utility in conjunction with a cabinet having a pair of doors, it will be understood by those skilled in the art that with slight modification the invention has use in cabinets having only a single door.

While the invention has been described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

What is claimed is:

1. A door lock mechanism for a door hingedly supported on a frame, comprising a pair of discrete elements for attachment respectively to the door and to the frame and adapted to be interengaged as the door is moved to a closed position, and latch means cooperable with the discrete elements to retain the door in said closed position, one of the discrete elements comprising a stud having an attachment base at one end thereof, a camming head at a free end of the stud opposite to the base and provided with a tapering forward camming surface, and means defining a latching recess intermediate the base and the camming head, the other of the discrete element comprising a lock body having means defining a cavity adapted to receive the stud therewithin as the door is moved to said closed position, and a rim portion defining an entrance to the cavity and formed to cooperate with and substantially surround the camming head as the door is moved to said closed position to guide the stud into the cavity and thereby correct any misalignment of the door with the frame, the latch means being carried by the lock body and comprising a latch member having a detent end portion, the latch member being mounted for reciprocating movement transversely relative to the cavity to and from a latching position in which the detent end portion obtrudes into the cavity to be seated in the latching recess when the stud is received in the cavity, thereby releasably retaining the stud within the cavity to releasably retain the door in said closed position, and means biasing the latch member toward the latching position, the means defining the latching recess of the stud including a rear camming surface adapted to engage the detent end portion of the latch member to urge the latch member away from the latching position thereof in opposition to the biasing means as the door is moved from said closed position to an open position;

said cavity-defining means comprises a cup member extending inwardly of the lock body from the rim portion thereof and having a lateral wall, a bottom wall closing the lateral wall at the inner end thereof, and means defining an aperture in the lateral wall disposed to receive the detent end of the latch member therethrough.

2. A door lock mechanism for a door hingedly supported on a frame, comprising a pair of discrete elements for attachment respectively to the door and to the frame and adapted to be interengaged as the door is moved to a closed position, and latch means cooperable with the discrete elements to retain the door in said closed position, one of the discrete elements comprising a stud having an attachment base at one end thereof, a camming head at a free end of the stud opposite to the base and provided with a tapering forward camming surface, and means defining a latching recess intermediate the base and the camming head, the other of the discrete element encompassing a lock body having means defining a cavity adapted to receive the stud therewithin as the door is moved to said closed position, and a rim portion defining an entrance to the cavity and formed to cooperate with and substantially surround the camming head as the door is moved to said closed position to guide the stud into the cavity and thereby correct any misalignment of the door with the frame, the latch means being carried by the lock body and comprising a latch member having a detent end portion, the latch member being mounted for reciprocating movement transversely relative to the cavity to and from a latching position in which the detent end portion obtrudes into the cavity to be seated in the latching recess when the stud is received in the cavity, thereby releasably retaining the stud within the cavity to releasably retain the door in said closed position, and means biasing the latch member toward the latching position, the means defining the latching recess of the stud including a rear camming surface adapted to engage the detent end portion of the latch member to urge the latch member away from the latching position thereof in opposition to the biasing means as the door is moved from said closed position to an open position;

a security lock means carried by the lock body and selectively movable between an unlocked position and a locked position obstructing movement of the latch member from the latching position to prevent movement of the door from said closed position;

the security lock means comprising a key-actuated cylinder lock mounted in the lock body for rotation between the unlocked position and the locked position, and a locking cam carried by the cylinder lock for rotation therewith, the locking cam being positioned to be engaged by an end of the latch member opposite to the detent end portion thereof when the cylinder lock is in the locked position, whereby to obstruct movement of the latch member from the latching position, the locking cam being positioned out of engagement with said opposite end of the latch member and out of the path of said movement thereof from the latching position when the cylinder lock is in the unlocked position.

3. A door lock mechanism for a door hingedly supported on a frame, comprising a pair of discrete elements for attachment respectively to the door and to the frame and adapted to be interengaged as the door is moved to a closed position, and latch means cooperable with the discrete elements to retain the door in said closed position, one of the discrete elements comprising a stud having an attachment base at one end thereof, a camming head at a free end of the stud opposite to the base and provided with a tapering forward camming surface, and means defining a latching recess intermediate the base and the camming head, the other of the discrete element comprising a lock body having means defining a cavity adapted to receive the stud therewithin as the door is moved to said closed position, and a rim portion defining an entrance to the cavity and formed to cooperate with and substantially surround the camming head as the door is moved to said closed position to guide the stud into the cavity and thereby correct any misalignment of the door with the frame, the latch means being carried by the lock body and comprising a latch member having a detent end portion, the latch member being mounted for reciprocating movement transversely relative to the cavity to and from a latching position in which the detent end portion obtrudes into the cavity to be seated in the latching recess when the stud is received in the cavity, thereby releasably retaining the stud within the cavity to releasably retain the door in said closed position, and means biasing the latch member toward the latching position, the means defining the latching recess of the stud including a rear camming surface adapted to engage the detent end portion of the latch member to urge the latch member away from the latching position thereof in opposition to the biasing means as the door is moved from said closed position to an open position;

the biasing means comprises a spring having a central helical portion supported on the body, and a leg portion extending from the central portion to engage the latch member;

the latch member is formed with a notch interrupting an inner lateral surface thereof, the leg portion of the biasing means being received in the notch.

4. A door lock mechanism for a door hingedly supported on a frame, comprising a pair of discrete elements for attachment respectively to the door and to the frame and adapted to be interengaged as the door is moved to a closed position, and latch means cooperable with the discrete elements to retain the door in said closed position, one of the discrete elements comprising a stud having an attachment base at one end thereof, a camming head at a free end of the stud opposite to the base and provided with a tapering forward camming surface, and means defining a latching recess intermediate the base and the camming head, the other of the discrete element comprising a lock body having means defining a cavity adapted to receive the stud therewithin as the door is moved to said closed position, and a rim portion defining an entrance to the cavity and formed to cooperate with and substantially surround the camming head as the door is moved to said closed position to guide the stud into the cavity and thereby correct any misalignment of the door with the frame, the latch means being carried by the lock body and comprising a latch member having a detent end portion, the latch member being mounted for reciprocating movement transversely relative to the cavity to and from a latching position in which the detent end portion obtrudes into the cavity to be seated in the latching recess when the stud is received in the cavity, thereby releasably retaining the stud within the cavity to releasably retain the door in said closed position, and means biasing the latch member toward the latching position, the means defining the latching recess of the stud including a rear camming surface adapted to engage the detent end portion of the latch member to urge the latch member away from the latching position thereof in opposition to the biasing means as the door is moved from said closed position to an open position;

the biasing means comprises a spring having a central helical portion supported on the body, and a leg portion extending from the central portion to engage the latch member;

the lock body further comprises a base plate having means for securing the base plate to the frame, the base plate being provided with a bosses extending inwardly therefrom, the boss being formed to receive the central portion of the spring thereon in supporting relation thereto.

5. A lock mechanism for a door hingedly supported on a frame, comprising a pair of discrete elements for attachment respectively to the door and to the frame and adapted to be interengaged as the door is moved to a closed position, and latch means cooperable with the discrete elements to retain the door in said closed position, one of the discrete elements comprising a stud having an attachment base at one end thereof, a camming head at a free end of the stud opposite to the base and provided with a tapering forward camming surface, and means defining a latching recess intermediate the base and the camming head, the other of the discrete elements comprising a lock body having means defining a cavity adapted to receive the stud therewithin as the door is moved to said closed position, and a rim portion defining an entrance to the cavity and formed to cooperate with the camming head as the door is moved to said closed position to guide the stud into the cavity and thereby correct any misalignment of the door with the frame, the latch means being carried by the lock body and comprising a latch member having a detent end portion, the latch member being mounted for reciprocating movement transversely relative to the cavity to and from a latching position in which the detent end portion obtrudes into the cavity to be seated in the latching recess when the stud is received in the cavity, thereby releasably retaining the stud within the cavity to releasably retain the door in said closed position, and a spring biasing the latch member toward the latching position and having a central helical portion supported on the body, and a leg portion extending from the central portion to engage the latch member, the latch member being formed with a notch interrupting an inner lateral surface thereof, the leg portion of the spring being received in the notch, the notch being defined by a back surface thereof offset from the inner lateral surface of the latch member, and a pair of opposed convex side surfaces thereof intersecting the inner lateral surface and the back surface, whereby the length of the notch is smaller at the center thereof than at either side thereof.

6. A lock mechanism for a door hingedly supported on a frame, comprising a pair of discrete elements for attachment respectively to the door and to the frame and adapted to be interengaged as the door is moved to a closed position, and latch means cooperable with the discrete elements to retain the door in said closed position, one of the discrete elements comprising a stud having an attachment base at one end thereof, a camming head at a free end of the stud opposite to the base and provided with a tapering forward camming surface, and means defining a latching recess intermediate the base and the camming head, the other of the discrete elements comprising a lock body having means defining a cavity adapted to receive the stud therewithin as the door is moved to said closed position, and a rim portion defining an entrance to the cavity and formed to cooperate with the camming head as the door is moved to said closed position to guide the stud into the cavity and thereby correct any misalignment of the door with the frame, the latch means being carried by the lock body and comprising a latch member having a detent end portion, the latch member being mounted for reciprocating movement transversely relative to the cavity to and from a latching position in which the detent end portion obtrudes into the cavity to be seated in the latching recess when the stud is received in the cavity, thereby releasably retaining the stud within the cavity to releasably retain the door in said closed position, and means biasing the latch member toward the latching position, the lock body comprising a base plate having means for securing the base plate to the frame, and a pair of flanges extending inwardly from the base plate in parallel spaced relationship to define a channel therebetween, the latch member being received in the channel in sliding relation to the base plate, whereby said movement of the latch member to and from the latching position is guided by the flanges, one of the flanges having a slot formed therein to provide the biasing means with access to the latch member.

7. A door lock mechanism for a pair of doors hingedly supported on a frame for movement toward and away from one another to and from adjacent closed positions, the lock mechanism comprising a pair of studs for attachment respectively to the doors, a lock body for attachment to the frame, the lock body and each of the studs being adapted to be interengaged as the respective door is moved to the closed position thereof, and latch means adapted to cooperate with each of the studs and the lock body to retain the respective door in the closed position thereof, each of the studs having an attachment base at one end thereof, a camming head at a free end of each of the studs opposite to said one end and provided with a tapering axisymmetrical forward camming surface, and means defining a latching recess intermediate the base and the camming head, the lock body having means defining a pair of cavities each adapted to receive a corresponding one of the studs therewithin as the respective door is moved to the closed position thereof, and a pair of rim portions each defining an entrance to a corresponding one of the cavities and formed to cooperate with the camming head of one of the studs as the respective door is moved to the closed position thereof to guide said one stud into said one cavity and thereby correct any misalignment of the respective door with the frame and with the other of the doors, the latch means being carried by the lock body and comprising a pair of latch members having respective detent end portions, each of the latch members being mounted for reciprocating movement transversely relative to a corresponding of the cavities to and from a latching position in which the respective detent end portion obtrudes into said one cavity to be seated in the latching recess of a corresponding one of the studs when said one stud is received in said one cavity to releasably retain the respective door in the closed position thereof, means biasing the latch members toward the respective latching positions, and a security lock means carried by the lock body and selectively movable between an unlocked position and a locked position obstructing movement of the latch members for the respective latching positions.

8. A door lock mechanism according to claim 7, wherein the security lock means comprises a key-actuated cylinder lock mounted in the lock body for rotation between the unlocked position and the locked position, and a locking cam carried by the cylinder lock for rotation therewith, the locking cam being positioned to be engaged by an end of each of the latch members opposite to the detent end portion thereof when the cylinder lock is in the locked position, whereby to obstruct movement of the latch members from the respective latching positions, the locking cam being positioned out of engagement with said opposite ends of the latch members and out of the paths of said movement thereof from the respective latching positions when the cylinder lock is in the unlocked position.

9. A door lock mechanism for a pair of doors hingedly supported on a frame for movement toward and away from one another to and from adjacent closed positions, the lock mechanism comprising a pair of studs for attachment respectively to the doors, a lock body for attachment to the frame, the lock body and each of the studs being adapted to be interengaged as the respective door is moved to the closed position thereof, and latch means adapted to cooperate with each of the studs and the lock body to retain the respective door in the closed position thereof, each of the studs having an attachment base at one end thereof, a camming head at a free end of each of the studs opposite to said one end and provided with a tapering axisymmetrical forward camming surface, and means defining a latching recess intermediate the base and the camming head, the lock body having means defining a pair of cavities each adapted to receive a corresponding one of the studs therewithin as the respective door is moved to the closed position thereof, and a pair of rim portions each defining an entrance to a corresponding one of the cavities and formed to cooperate with the camming head of one of the studs as the respective door is moved to the closed position thereof to guide said one stud into said one cavity and thereby correct any misalignment of the respective door with the frame and with the other of the doors, the latch means being carried by the lock body and comprising a pair of latch members having respective detent end portions, each of the latch members being mounted for reciprocating movement transversely relative to a correspondingly one of the cavities to and from a latching position in which the respective detent end portion obtrudes into said one cavity to be seated in the latching recess of a corresponding one of the studs when said one stud is received in said one cavity to releasably retain the respective door in the closed position thereof, and a spring biasing the latch members toward the respective latching positions and having a central helical portions supported on the body, and a pair of leg portions extending oppositely from the central portion to respectively engage the latch members, the lock body comprising a base plate having means for securing the base plate to the frame, a pair of cups extending inwardly from the base plate to define said cavities, and a boss extending inwardly from the base plate at a location equidistant from the cups and formed to receive the central portion of the spring thereon in supporting relation thereto.

* * * * *